United States Patent [19]

Musbach

[11] 4,082,623

[45] Apr. 4, 1978

[54] METHOD OF ELECTROPLATING SMALL PARTS WITH CHROME SUBSTITUTE TIN ALLOYS AND ELECTROPLATING BARREL THEREFOR

[75] Inventor: Alan Jon Musbach, Rochester, Mich.

[73] Assignee: M.C.P. Industries, Inc., Troy, Mich.

[21] Appl. No.: 717,985

[22] Filed: Aug. 26, 1976

[51] Int. Cl.[2] ..... C25D 3/56; C25D 3/60; C25D 17/20

[52] U.S. Cl. ..... 204/43 S; 204/43 T; 204/213

[58] Field of Search ..... 204/213, 214, 43 S, 204/43 T

[56] References Cited

U.S. PATENT DOCUMENTS

| | | | |
|---|---|---|---|
| 950,068 | 2/1910 | Emery et al. | 204/213 |
| 1,251,568 | 1/1918 | Potthoff | 204/213 |
| 1,285,369 | 11/1918 | Potthoff | 204/213 |
| 3,803,007 | 4/1974 | Jessup | 204/213 X |
| 3,844,923 | 10/1974 | Sandrock | 204/213 X |
| 3,846,271 | 11/1974 | Singleton | 204/213 X |

FOREIGN PATENT DOCUMENTS

| | | | |
|---|---|---|---|
| 1,070,468 | 12/1959 | Germany | 204/214 |
| 2,031,264 | 12/1971 | Germany | 204/213 |
| 265,372 | 6/1929 | Italy | 204/213 |
| 464,334 | 6/1951 | Italy | 204/213 |
| 356,315 | 10/1972 | U.S.S.R. | 204/213 |

*Primary Examiner*—G. L. Kaplan
*Attorney, Agent, or Firm*—Harness, Dickey & Pierce

[57] ABSTRACT

A method of electroplating tin - cobalt, tin - nickel or tin - cobalt - nickel alloys as a substitute for chrome plating. An electroplating barrel having dangler members of a length sufficient to contact and partially overlay the inner surface of said barrel is disclosed for performing said method.

10 Claims, 3 Drawing Figures

FIG. 1.
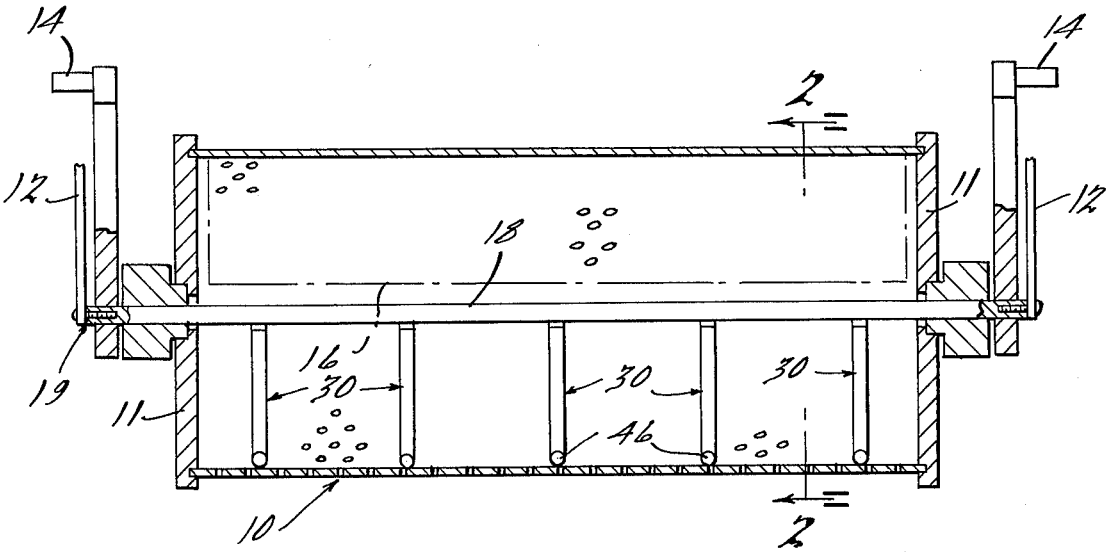
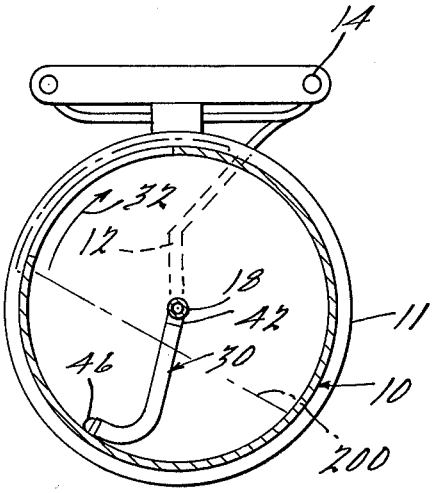
FIG. 2.
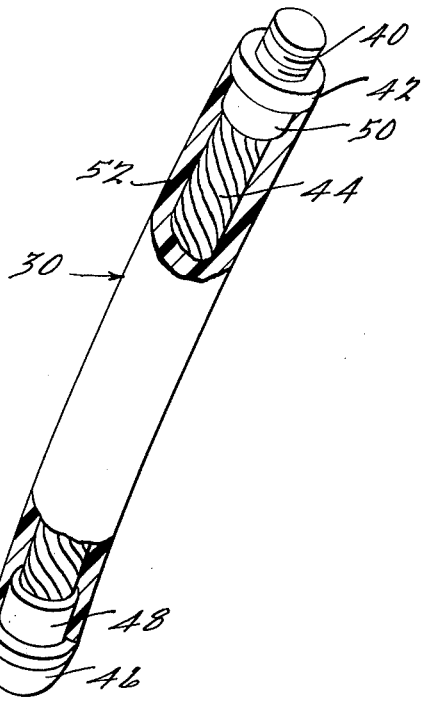
FIG. 3.

METHOD OF ELECTROPLATING SMALL PARTS WITH CHROME SUBSTITUTE TIN ALLOYS AND ELECTROPLATING BARREL THEREFOR

BACKGROUND OF THE INVENTION

This invention broadly relates to a new plating barrel construction with a special cathode dangler assembly. More particularly this invention relates to a special type of cathode dangler assembly for use in a plating barrel wherein metal substrate parts have applied thereto a chrome substitute metal plating or other type of metal plating.

The state of the art is indicated by the following cited references: Potthoff U.S. Pat. No. 1,285,369; Amundsen U.S. Pat. No. 2,120,478; Daniels U.S. Pat. 888,068; Sandrock U.S. Pat. No. 3,844,923; Jackson U.S. Pat. 3,153,624; Lazaro U.S. Pat. No. 3,421,992; Jackson U.S. Pat. 2,762,772; and Hage U.S. Pat. Nos. 3,884,116 and 3,926,569. The references above referred to are incorporated herein by reference. The Potthoff patent electroplating apparatus is unsatisfactory from the standpoint that its cathodes are overly loose and they would rotate to the top of the barrel thus making Potthoff's construction unsatisfactory because it would lead to very poor plating if attempted for use in the system of this invention. The Daniels patent apparatus would be unsatisfactory for carrying out this invention because in Daniels the weight of the dangler member is depended on for holding the dangler down in the work load and this would not be satisfactory herein, moreover, it would be extremely difficult to insulate or solution seal the Daniels plating barrel and it would be very difficult to change the danglers. The Amundsen patent construction would be deficient for carrying out the invention herein for basically the same reasons as the Daniel and Potthoff patents.

One object of the present invention is to provide a new electroplating barrel construction with a special dangling cathode assembly.

Another object of the present invention is to provide an improved electroplating barrel construction and a method of manufacturing electroplated parts of same.

Another object of the present invention is to provide a special cathode dangler assembly construction for use in plating barrels.

Another object of the present invention is to provide a special electroplating barrel construction for use in preparing chrome substitute metal plated parts.

Another object of the present invention is to provide a special method of manufacturing chrome substitute metal plated parts using a special cathode dangler assembly.

Other objects, features and advantages of the present invention will become apparent from the subsequent description and the appended claims taken in conjunction with the accompanying drawings.

SUMMARY OF THE INVENTION

Briefly stated, the present invention involves an electroplating means for applying a chrome substitute metal plating to parts being plated, comprising, a rotatable electroplating barrel with an entry-exit door disposed therein, support means for supporting the barrel and for raising and lowering it in and out of a chrome substitute plating solution, selected from at least one of the group consisting of a tin-cobalt plating solution, a tin-nickel-cobalt plating solution, or a tin-nickel plating solution, a special cathode dangler assembly within said barrel and including, a central bar member which generally runs the length of the barrel and which is generally fixed and nonrotatable during plating, at least three dangler members attached to and depending radially downwardly from said central bar, with said dangler members being generally flexed in a direction in which the barrel rotates, said dangler member being made of a flexible metal strand electrical cable material which has a corrosion resistant metal contact head at one end thereof which is submersed in the parts being plated, said metal strand material being sheathed in a flexible plastic sheath member, and the other end of said dangler member being a fitting means readily connectable to said central bar. Preferably there are between one and about four dangler members per foot of barrel length and best results have been obtained using a plating barrel having between four and six dangler members disposed therein. The central bar member is connected to the support means by a cathode buss which is electrically insulated and which has an anti-rotation friction surface thereon.

From a method aspect the present invention involves a method of manufacturing electroplated parts with a chrome substitute metal plating thereon, comprising the steps of placing the parts to be plated in a rotatable electroplating barrel through an entry-exit door disposed therein, said barrel including a central bar member which generally runs the length of the barrel and which is generally fixed and non-rotatable during plating, at least three dangler members attached to and depending radially downwardly from said central bar, with said dangler members being generally flexed in a direction in which the barrel rotates, said dangler member being made of a flexible metal strand electrical cable material which has a corrosion resistant metal contact head at one end thereof which is submersed in the parts being plated, said metal strand material being sheathed in a flexible plastic sheath member, and the other end of said dangler member being a fitting means readily connectable to said central bar, submerging said barrel in a chrome substitute plating solution selected from at least one of the group consisting of a tin-cobalt plating solution, a tin-nickel-cobalt plating solution, or a tin-nickel plating solution, to thereby complete an electrical circuit for carrying out the electroplating, rotating said barrel during said electroplating in a direction of rotation which will maintain said dangler members at optimum immersion in said parts being plated, said submerging being carried out for a time period of between about ½ and about 25 minutes, and with a plating current being applied during said submerging of between about ½ and about 60 amperes per square foot removing the barrel from the plating solution and rinsing the parts.

BRIEF DESCRIPTION OF THE DRAWINGS

FIG. 1 is a cross-sectional view of an electroplating barrel in accordance with this invention showing the cathode dangler assembly used therein;

FIG. 2 is a sectional view of the plating barrel of FIG. 1 taken along the line 2—2 of FIG. 1; and, FIG. 3 is a detailed view showing one particular embodiment of a cathode dangler member of the type used in FIG. 1.

DESCRIPTION OF PREFERRED EMBODIMENTS

FIGS. 1, 2 and 3 show a preferred embodiment and construction for carrying out the present invention.

FIG. 1 illustrates a plating barrel 10 which is supported by a frame and horns designated 12 and 14 respectively (Jackson U.S. Pat. No. 3,153,624 is exemplary of a barrel that could be used). The plating barrel 10 is comprised of end closure members 11 which are of similar construction except for the differences between right and left hand orientation. The barrel 10 also includes a hinged door designated 16. Through the center of the plating barrel 10 there is disposed a cathode dangler assembly comprised of a central bar member 18 which is non-rotatable and fixed during the actual plating operation though it is adjustable, that is, rotatable about its longitudinal axis for purposes of adjustment prior to carrying out of the plating operation. Any suitable means may be used for rotational adjustment of the central bar member 18 such as the bolt means shown at 19.

A plurality of dangler members 30 are shown disposed within the barrel and depending radially downwardly from the central bar member 18. The direction of rotation of the plating barrel 18 is best seen and exemplified in FIG. 2 by the arrow 32 and it is seen that the direction of rotation of the barrel 32 is in a direction such that the dangler member 30 is flexed in the same direction as the direction of rotation of the barrel such that when the parts to be plated are positioned in the barrel the dangler member will be subjected to optimum immersion within the parts being plated, and this is very important to operation of the invention.

FIG. 3 illustrates a detailed view of the dangler member 30 and the dangler member is comprised of a threaded end portion designated 40 which is part of the end fitting designated 42 and the end fitting is connected to a flexible metallic strand member designated 44 which is made up of a multiple strand metal cable material such as of copper, steel or stainless steel, or the like. The flexible metal strand is connected at its opposite end to a steel or other acid resistant metal contact member or head designated 46 through means of the collar or connecting fitting 48 which is crimped or otherwise suitably attached to the metal strand cable material. Likewise in a similar fashion collar portion 50 of the end fitting 42 is also crimped or otherwise suitably attached to a metallic strand material 44. The metallic strand material is insulated and covered by a plastic insulation jacket designated 52 which preferably is made of a Tygon plastic material or other suitable flexible plastic material such as an acrylic or vinyl plastic. As shown by FIGS. 1 and 3 the dangler members 30 are attached to the central bar member 18 by means of threading the dangler member into suitably tapped holes in the central bar member 18 whereby the threads 40 of the dangler member 30 are operative to provide a tight threaded connection between the dangler 30 and the center bar member 18.

The operating procedure or steps of manufacture for preparing plated metal parts using the invention disclosed herein are as follows. First the plating barrel is opened and the parts to be plated are inserted into the barrel through the hinged door 16. Normally the parts to be plated with the chrome substitute metal plating as referred to herein are parts which have already been nickel plated or are otherwise in a condition to accept a chrome substitute metal plating. The lid on the barrel is then closed and the barrel is transferred to a plating tank and submerged in the plating solution. The plating solution preferably is of a type suitable for applying a chrome substitute metal plating such as a tin-cobalt plating solution for this purpose as disclosed in Hage, U.S. Pat. Nos. 3,884,116 and 3,926,569. Other chrome substitute plating solutions may also be used such as a tin-nickel-cobalt plating solution or a tin-nickel plating solution (e.g., the Hage patents). Once the barrel is submerged in the plating solution this completes the electrical circuit and the barrel is then rotated during the plating in a direction (see arrow 32) which will make optimum use of the dangler member positioning, that is, such that the dangler members 30 are well submersed within the load or parts being plated (depicted by the load level 200 in FIG. 2). The time of submersion in the plating solution is broadly maintained within the range of about ½ to about 25 minutes and preferably within the range of about 1 to about 6 minutes, with best results being obtained when a time of submersion between about 2 and about 5 minutes is utilized. The average amperes per square foot electrical current applied during the plating operation should broadly be maintained within the range of about ½ to about 60 amps per square foot and preferably it is maintained within the range of about 2 to about 20 amps per square foot, with best results being obtained within the range of about 2 to about 6 amps per square foot. After the plating time period is completed the barrel is removed from the plating solution and the parts are then rinsed thoroughly and the barrel is opened and the parts are unloaded.

The advantages and novel features of the invention are as follows. First, conventional dangler systems which have been utilized in the past are limited in the number of physical contacts that they can make with the plating load. Therefore the current had to be conducted from part to part through the work load in the past and this has led to very inefficient plating when chrome substitute metal platings are being applied. In the cathode dangler assembly of the present invention the system puts current into the work load at multiple points thereby reducing the part to part electrical transfer distance. Second, because of the relatively short length of the electrical conductors used in the dangler system of this invention the dangler members are therefore always optimally submerged in the load or the production parts being coated and, this therefore reduces the non-productive plating on the cathode contact head. Third, conventional or prior art dangler members tend to ride to the top of the work load or the load of parts being plated and this has led to inefficient and uneconomical plating. Fourth, because of the multiplicity of contacts used in the cathode dangler assembly of the present invention partial inoperativeness of any dangler contact is not overly harmful because the other danglers in the assembly will compensate for and lead to good plating results. Fifth, the dangler members of the present invention are more readily connected to and/or disconnected from the central bar member 18, for example through the use of threaded connections as shown at element 40 in FIG. 3 or through other suitable connecting means. Sixth, in the present invention the dangler members can be made considerably smaller than conventional danglers which have been used in the past and therefore the operating costs are significantly reduced. Seventh, through the use of the inventive system herein disclosed there is a unique ability to get the current through the load on an optimum basis and this is a very important characteristic of this invention. Eighth, because the central bar member can be rotated and then fixed in position this means that one using the plating barrel construction and cathode dangler assembly of this invention can position the dangler contacts in an optimum position within the plating load during the plating deposition.

Typical examples of plating solutions which can be used for the application of a chrome substitute metal plating in accordance with the invention herein are as follows:

EXAMPLE 1

Stannochlor compound ($SnCl_2$): 6.2 oz./gal.
Nickel chloride ($NiCl_2 6H_2O$): 39.0 oz./gal.
Ammonium bifluoride ($NH_4HF_2$): 7.5 oz./gal.
Ammonium hydroxide to pH of: 2.5

EXAMPLE 2

Cobalt-tin type bath
Stannous chloride ($SnCl_2$): 6.0 oz./gal.
Cobalt Chloride ($CoCl_2 6H_2O$): 50.0 oz./gal.
Ammonium bifluoride ($NH_4HF_2$): 11.0 oz./gal.
Ammonium chloride ($NH_4Cl$): 5.0 oz./gal.

While it will be apparent that the preferred embodiments of the invention disclosed are well calculated to fulfill the objects above stated it will be appreciated that the invention is susceptible to modification, variation and change without departing from the proper scope or fair meaning of the subjoined claims.

What is claimed is:

1. An electroplating means for applying a chrome substitute metal plating, comprising, a rotatable electroplating barrel with an entry-exit door disposed therein, support means for supporting the barrel and for raising and lowering it in and out of a chrome substitute plating solution, selected from at least one of the group consisting of a tin-cobalt plating solution, a tin-nickel-cobalt plating solution, or a tin-nickel plating solution, a special cathode dangler assembly within said barrel and including, a central bar member which generally runs the length of the barrel and which is generally fixed and non-rotatable during plating, at least three dangler members attached to and depending radially downwardly from said central bar, with said dangler members being of a length sufficient to contact and partially overlay the inner surface of said barrel and being generally flexed in a direction in which the barrel rotates due to the contact with said barrel, said dangler member being made of a flexible metal strand electrical cable material which has a metal contact head at one end thereof, said metal strand material being sheathed in a flexible plastic sheath member, and the other end of said dangler member being a fitting means readily connectable to said central bar.

2. The invention of claim 1 wherein, there are between one and about four dangler members per foot of barrel length.

3. The invention of claim 2 wherein, said central bar is connected to said support means by a cathode buss which is electrically insulated and which has an anti-rotation friction surface thereon.

4. The invention of claim 3 wherein, said barrel has from four to six dangler members disposed therein.

5. An electroplating means for applying a metal plating, comprising, a rotatable electroplating barrel with an entry-exit door disposed therein, support means for supporting the barrel and for raising and lowering it in and out of a plating solution, a special cathode dangler assembly within said barrel and including, a central bar member which generally runs the length of a barrel and which is generally fixed and non-rotatable during plating, at least three dangler members attached to and depending radially downwardly from said central bar, with said dangler members being of a length sufficient to contact and partially overlay the inner surface of said barrel and being generally flexed in a direction in which the barrel rotates due to the contact with said barrel, said dangler member being made of a flexible metal strand electrical cable material which has a metal contact head at one end thereof, said metal strand material being sheathed in a flexible sheath member, and the other end of said dangler member being a fitting means readily connectable to said central bar.

6. A method of manufacturing electroplated parts with a chrome substitute metal plating thereon, comprising the steps of:

placing the parts to be plated in a rotatable electroplating barrel through an entry-exit door disposed therein, said barrel including a central bar member which generally runs the length of the barrel and which is generally fixed and non-rotatable during plating, at least three dangler members attached to and depending radially downwardly from said central bar, with said dangler members being of a length sufficient to contact and partially overlay the inner surface of said barrel and being generally flexed in a direction in which the barrel rotates due to the contact with said barrel, said dangler member being made of a flexible metal strand electrical cable material which has a corrosion resistant metal contact head at one end thereof which is submersed in the parts being plated, said metal strand material being sheathed in a flexible plastic sheath member, and the other end of said dangler member being a fitting means readily connectable to said central bar, submerging said barrel in a chrome substitute plating solution selected from at least one of the group consisting of a tin-cobalt plating solution, a tin-nickel-cobalt plating solution, or a tin-nickel plating solution, to thereby complete an electrical circuit for carrying out the electroplating, rotating said barrel during said electroplating in a direction of rotation which will maintain said dangler members at optimum immersion in said parts being plated, said submerging being carried out for a time period of between about ½ and about 25 minutes, and with a plating current being applied during said submerging of between about ½ and about 60 amperes per square foot.

removing the barrel from the plating solution and rinsing the parts.

7. The invention of claim 6 wherein, said time period of submerging is between about 1 and about 6 minutes.

8. The invention of claim 6 wherein, said plating current is between about 2 and about 20 amps/ft.$^2$ 9. The invention of claim 6 wherein, said time period of submerging is between about 2 and about 5 minutes, and said plating current is between about 2 and about 6 amps/ft.$^2$ 10. An electroplating means for applying a chrome substitute metal plating, comprising, a rotatable electroplating barrel with an entry-exit door disposed therein, support means for supporting the barrel and for raising and lowering it in and out of a chrome substitute plating solution, selected from at least one of the group consisting of a tin-cobalt plating solution, a tin-nickel-cobalt plating solution, or a tin-nickel plating solution, a special cathode dangler assembly within said barrel and including, a central bar member which generally runs the length of the barrel and which is generally fixed and non-rotatable during plating, said central bar being connected to said support means by a cathode buss which is electrically insulated and which has an anti-rotation friction surface thereon, between about one and about four dangler members per foot of barrel length attached to and depending radially downwardly from said central bar, with said dangler members being of a length sufficient to contact and partially overlay the inner surface of said barrel and being generally flexed in a direction in which the barrel rotates due to contact with said barrel, said dangler member being made of a flexible metal strand electrical cable material which has a metal contact head at one end thereof, said metal strand material being sheathed in a flexible plastic sheath member, and the other end of said dangler member being a fitting means readily connectable to said central bar.

* * * * *